United States Patent [19]

Mallick, Jr.

[11] Patent Number: 4,631,629

[45] Date of Patent: Dec. 23, 1986

[54] SOLENOID CONTROL CIRCUIT

[75] Inventor: George T. Mallick, Jr., Penn Hills Township, Allegheny County, Pa.

[73] Assignee: Westinghouse Electric Corp., Pittsburgh, Pa.

[21] Appl. No.: 775,917

[22] Filed: Sep. 13, 1985

[51] Int. Cl.[4] ..... H01H 47/22

[52] U.S. Cl. ..... 361/154

[58] Field of Search ..... 361/152, 154, 170, 187

[56] References Cited

U.S. PATENT DOCUMENTS

| | | | |
|---|---|---|---|
| 3,406,295 | 10/1968 | Corey | 307/132 |
| 3,577,040 | 5/1971 | Campbell, Jr. | 361/154 |
| 3,973,140 | 8/1976 | Phillips | 307/247 A |
| 4,012,673 | 3/1977 | Sarrem et al. | 361/196 |
| 4,096,542 | 6/1978 | Pappas et al. | 361/196 |
| 4,251,848 | 2/1981 | Dogadko et al. | 361/196 |
| 4,390,922 | 6/1983 | Pelliccia | 361/170 |
| 4,490,771 | 12/1984 | Huber et al. | 361/154 |
| 4,538,074 | 8/1985 | Fraden | 367/126 |

*Primary Examiner*—Michael L. Gellner
*Attorney, Agent, or Firm*—M. S. Yatsko

[57] ABSTRACT

Electrical apparatus is disclosed in which a line voltage supplies current to an electrically operated solenoid through an operable switch interconnected therebetween. A control circuit is coupled to the switch and controls the operation thereof such that the control circuit operates to increase the duration of current flow to the solenoid when the line voltage level decreases. The control circuit includes appropriate circuitry for generating a reference voltage independent of the line voltage level, for generating a control voltage proportional to the line voltage level, and for operating the switch to permit current flow to the solenoid whenever the control voltage exceeds the reference voltage. The control circuit can also include circuitry to increase the duration of current flow to the solenoid upon the occurrence of vibration with the solenoid above a predetermined level, and/or for increasing the duration of current flow upon initial energization of the solenoid.

8 Claims, 3 Drawing Figures

SOLENOID CONTROL CIRCUIT

GOVERNMENT RIGHTS STATEMENT

The Government has rights in this invention pursuant to Contract No, F2353-900 awarded by the United States Department of the Navy.

BACKGROUND OF THE INVENTION

This invention relates generally to control circuitry, and more particularly to a circuit for adjusting the power in a solenoid in response to line voltage changes.

In the operation of the solenoids, such as are often used in electronically operated motor controllers, it is not infrequently desirable to adjust the power input to the solenoid in response to abnormal operating conditions, or even at times in normal transient operations. For example, if the line voltage supplying power to the solenoid drops significantly below its normal value, and it is required that the solenoid generate enough force to keep the con tactor engaged, it is desirable to increase the power to the solenoid to prevent or overcome drop-out of such solenoid. Additionally, during normal closing operations, it may be desirable to increase power to the solenoid because such larger than normal current will result in a more positive pull-in of such solenoid. During operation, in shock or vibration situations, a heavier than normal current will lessen the probability of a drop-out.

SUMMARY OF THE INVENTION

In accordance with the present invention, an electronic circuit automatically adjusts the power input to a solenoid in response to changing input voltage levels, automatically providing a very heavy inital current to assist in the pull-in, and easily activated in response to transient conditions to provide transient current pulses which may be helpful to prevent or overcome drop-out. The circuitry includes a ramp-generator circuit, powered by a regulated voltage, and a direct current trigger voltage powered by an unregulated supply proportional to the peak voltage level of the line voltage. A comparator is utilized to determine when the ramp voltage exceeds that of the threshold trigger, which, when it so exceeds the threshold, activates a thyristor to cause current to flow to the solenoid. As the threshold level decreases in response to changes in the line voltage, the thyristor fires earlier and earlier, causing an increase in the duration of time that current is supplied to the solenoid, thereby increasing the total power supplied to the solenoid and assisting in preventing drop-out of the solenoid.

BRIEF DESCRIPTION OF THE DRAWINGS

Reference is now made through the description of the preferred embodiment, illustrated in the accompanying drawings, in which.

DESCRIPTION OF THE PREFERRED EMBODIMENTS

Figure 1:
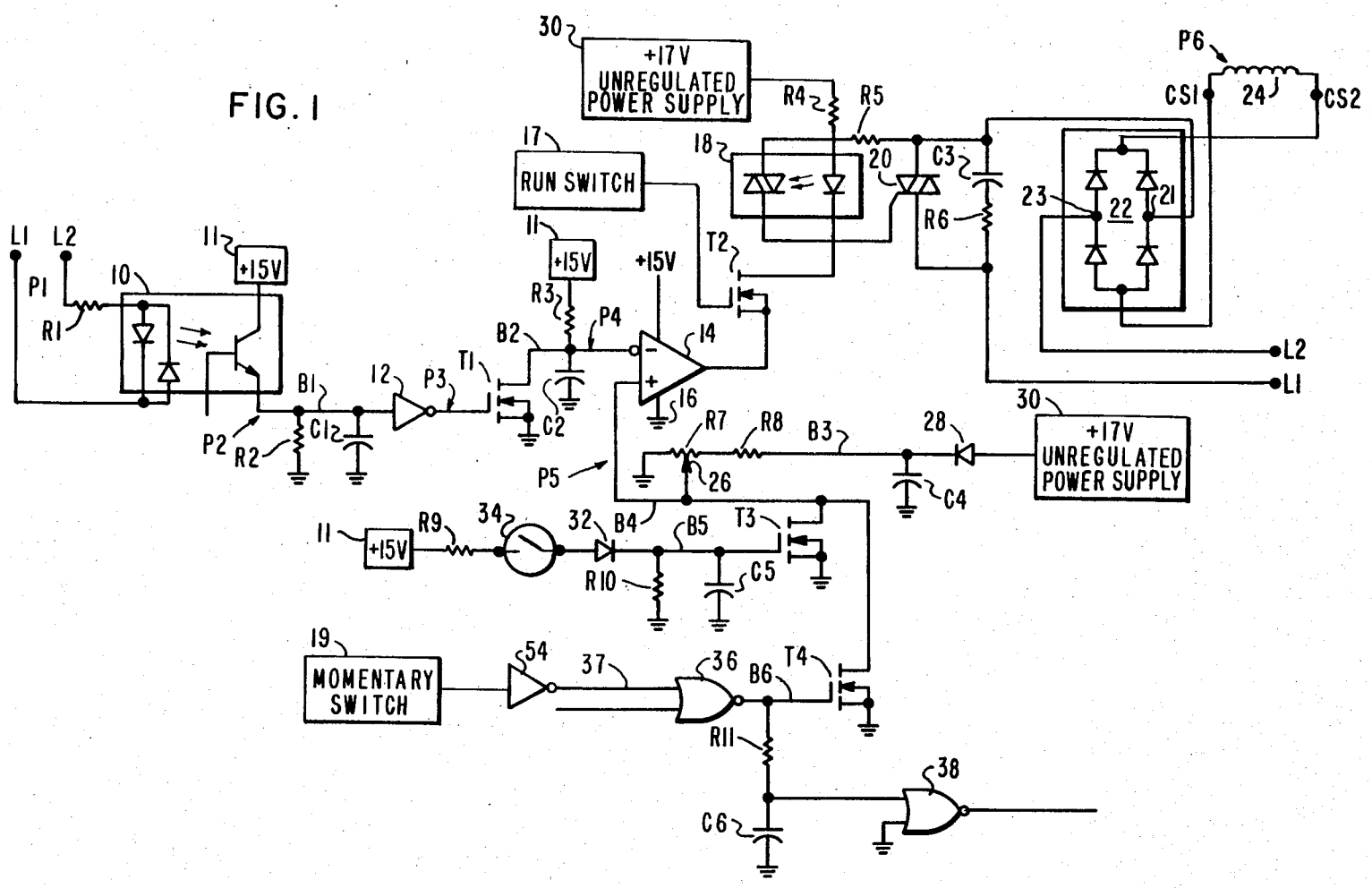
FIG. 1 is a detailed schematic of the circuitry of the present invention.

Referring now more particularly to FIG. 1, therein is illustrated the control circuitry utilized for adjusting power in a solenoid 24 in response to line voltage changes or other transient conditions. The incoming power lines L1, L2 are connected through the resistor R1 to an optical coupler 10. The optical coupler 10 is powered by a, preferably, 15 volt regulated power source 11, and has its output connected, through bus B1, to the input of the inverter 12. Connected between the bus B1 and ground, and parallel with each other, are resistor R2 and capacitor C1, which function as a noise filter, though in certain applications the capacitor C1 may not be required.

The output of the inverter 12 is connected to the gate of the field effect transistor T1. The source of transistor T1 is connected to ground, wile the drain of the transistor T1 is connected to the low input of the comparator 14 through bus B2. Connected between the 15 volt regulated power source 11 and the bus B2 is resistor R3, while capacitor C2 is connected between the bus B2 and ground. The comparator 14 is powered by its connection to the 15 volt regulated source 11, and has its negative supply lead connected to ground 16. The output side of the comparator 14 is connected to the source of field effect transistor T2, which has its gate connected to run switch 17 to therefore act as a switch to allow or inhibit current flow in the optical coupler 18. The drain of transistor T2 is connected to optical coupler 18, which is powered by a nominal 17 volt unregulated power source 30 through the resistor R4. The output of the optical coupler 18 is connected through resistor R5 to a thyristor 20 which, in turn, is connected in parallel with the series connection of resistor R6 and capacitor C3 which form a snubber network to limit the dV/dt across the thyristor 20. The thyristor 20 is installed in line L1 between the line voltage source and the input 21 to the full wave bridge rectifier circuit 22. The other input 23 of the bridge 22 is connected to line L2. The outputs of the bridge circuit 22 are connected, via nodes CS1 and CS2, to the solenoid 24.

The positive voltage, unregulated power source 30 produces a voltage output which is proportional to the peak voltage level generated in the lines L1 and L2, and can vary directly with changes in the voltage levels present therein. This unregulated voltage source 30, in addition to powering the optical coupler 18, also functions to provide the threshold trigger level for conduction of the tyristor 20 and thereby controls the current flow to the solenoid 24.

The unregulated supply 30 is connected to a diode 28, the output of which is supplied through bus B3 to the resistors R8 and R7. Capacitor C4 is connected between bus B3 and ground, and voltage tap 26 is connected between resistor R7 and bus B4, which bus B4 is connected to the high side of comparator 14. Bus B4 is also connected to the drain of field effect transistor T3 and to the drain of field effect transistor T4. The sources of both transistors T3 and T4 are connected to ground, while the gate of transistor T3 is connected through bus B5 to the rectified side of diode 32. Connected in parallel with each other, and extending from bus B5 to ground, are resistor R10 and capacitor C5. A 15 volt regulated power supply 11 supplies power through resistor R9 to shock switch 34, which is normally open, and which is connected to the rectifying end of diode 32.

The gate of field effect transistor T4 is connected to the output of NOR gate 36, which has one input 37 thereof connected to the output of the inverter 54 which inverter 54 has as its input the run switch 17. Connected to ground from the bus B6 between the NOR gate 36 and the gate of transistor T4 are the resistor R11 and capacitor C6.

The operation of the described circuitry will now be described as it controls current and power flow to the solenoid 24 during normal operation. At this time, it can be assumed that the run switch 17 has been activated, thereby turning on transistor T2. Additionally, the shock switch 34 will be assumed to be open, thereby not sending a signal to the gate of transistor T3, keeping T3 open, and the output of the NOR gate 36 will also not be sending a signal to the gate of transistor T3, likewise keeping transistor T4 open. The voltage at P5 is thus dependent only on the peak AC line voltage and the setting of petentiometer R7.

Figure 2:
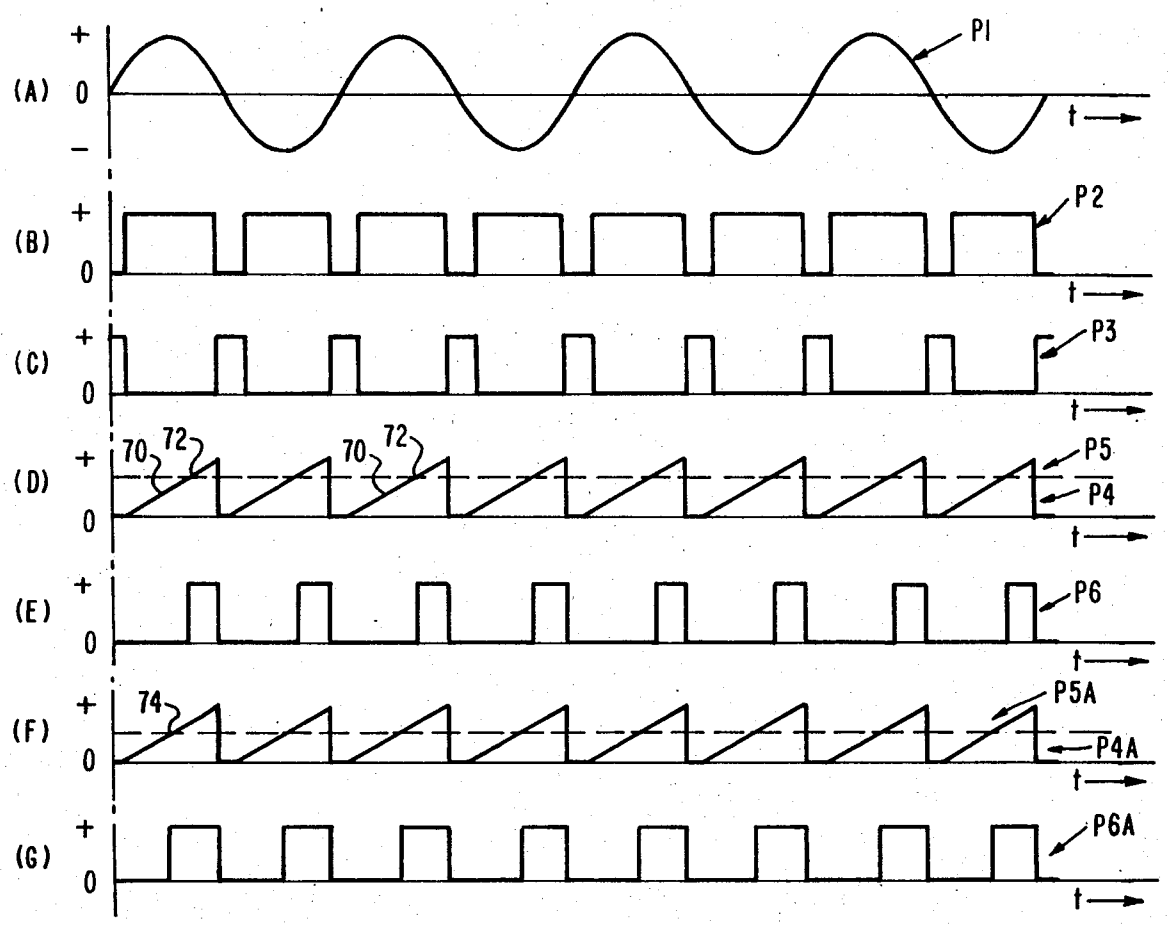
FIG. 2 is an illustration of the various voltage waveforms at selected portions of the circuitry of FIG. 1.

The voltage on lines L1 and L2 will be the typical AC sinusoidal wave shown in FIG. 2(A) as curve P1, which is the waveform at the point P1. This waveform is the input into the optical coupler 10, which functions as a switch which turns on at a predetermined, sufficient voltage level and the output of which coupler 10 goes to zero at the zero crossing of the input. The output of the optical coupler 10, at point P2, is shown as curve P2 in FIG. 2(B). In this curve, it can be seen that the output of the coupler 10 is a square wave which goes to zero at each zero crossing of the sinusoidal wave P1.

After having extraneous noise filtered by resistor R2 and capacitor C1, this output P2 is inverted by inverter 12, so as to obtain narrow, positive pulses corresponding to the zero crossing points of the sinusoidal input. The result of this inversion can be seen in Figure 2C as waveform P3, which corresponds to the voltage at point P3 in FIG. 1. This pulsed waveform is supplying the siganl of the gate of transistor T1, thereby turning transistor T1 on and off corresponding to the zero crossing point of the sinusoidal waveform P1. This pulsing of transistor T1, in conjunction with the resistor R3 and capacitor C2 operating upon the 15 volt regulated voltage source 11, functions to provide a ramp voltage to the low input of comparator 14. The waveform at this input point, designated P4, is illustrated in FIG. 2(D) as curve P4.

The 17 volt unregulated power supply 30, which varies as a function of the magnitude of the line voltage L1, L2, is rectified by the diode 28, filtered by capacitor C4, and supplied to the resistor R7. The variable voltage tap 26 functions to tap the voltage off resistor R7 and supply it to the high side input of comparator 14. The voltage tapped by the voltage tap 26 is essentially a DC voltage, and is illustrated in FIG. 2(D) as waveform P5, taken at point P5 of FIG. 1. The proportion of voltage tapped by the voltage tap 26 and supplied to the comparator 14 can be set by engineering or maintenance pesonnel as the level at which normal supply of power to the solenoid 24 should occur. It is this DC level, illustrated as curve P5, which sets the threshold trigger level at which current is supplied to the solenoid 24, as will hereinafter be explained.

Referring now more particularly to FIGS. 1 and 2(D), it can be noted that during the time in each cycle that the ramp voltage level P3 is lower than the threshold level P5 as, for example, at point 70, the comparator 14 will exhibit a high output and function as an open switch, thereby preventing current flow from the unregulated source 30 through the optical coupler 18 and through transistor T2 to ground and, correspondingly, keeping thyristor 20 from conducting. At that point 72 on the ramp voltage P4 that intersects the threshold voltage level P5, the comparator 14 output changes from a high to a low, functioning as if a switch closes, thereby enabling the current to flow from the unregulated supply 30 through the coupler 18 and the transistor T2 to ground 16. When this current is flowing through the coupler 18, the coupler acts to turn on the thyristor 20, which remains conducting until current ceases to flow at the zero crossing. When thyristor 20 is turned on, current is permitted to flow from line source L1 through the thyristor 20 to the input 21 of the full wave rectifier bridge 22, which current is then rectified and supplied to the solenoid 24. The waveform at the solenoid 24, at point P6, is illustrated in FIG. 2(E). Comparison of waveform P6 with waveforms P4 and P5 shows that current is conducted through the solenoid 24 only in that period of time at which the regulated ramp voltage P4 is equal to or exceeds the threshold level curve P5. This would occur for some predetermined time per cycle deemed by the designer to be sufficient to maintain the solenoid in its pulled-in position during normal circuit operation.

Upon the occurrence of a decreased line voltage level, the unregulated voltage source 30, being proportional to peak voltage levels of line voltage, will decrease, causing a corresponding decrease in the voltage level extracted from resistor R7 by the voltage tap 26 and which sets the threshold level input to the comparator 14. This resulting lower threshold level is illustrated in FIG. 2(F) as curve P5A. Because this threshold trigger level has been lowered, the point 74 at which the ramp voltage P4A equals the threshold level P5A occurs earlier in the cycle than under normal operating conditions (FIG. 2(D)). Since the thyristor 20 conducts when the ramp voltage P4A equals or exceeds the triggering threshold P5A, the current flow to the solenoid 24 occurs at an earlier time in the cycle than with the normal operating voltage levels found in FIG. 2(D). The result is an increase in the amount of time the current flows to the solenoid 24, as illustrated in FIG. 2(G), waveform P6A, which illustrates the amount of time that current flows to the solenoid 24. Comparing FIG. 2(E) with 2(G), it can be seen that the amount of time that current flow to the solenoid 24 is greater for waveform P6A than waveform P6, which occurs whenever the line voltage levels decrease.

Figure 3:
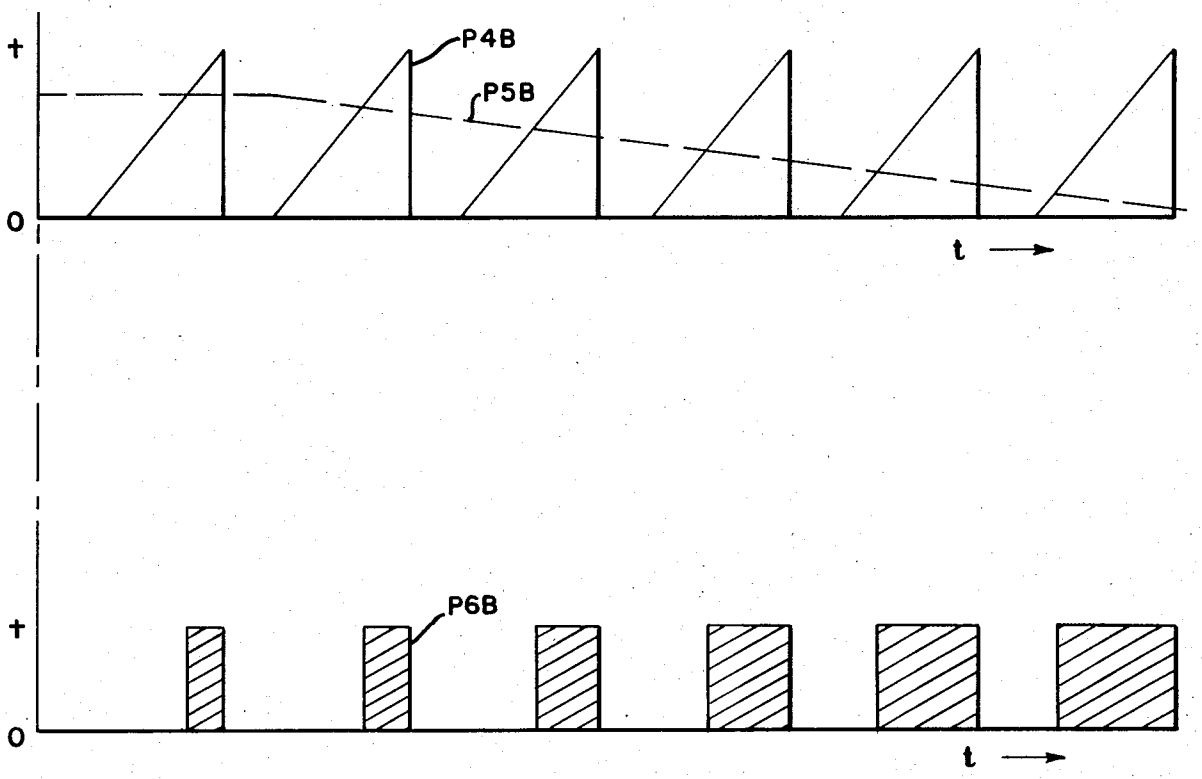
FIG. 3 is an expanded illustration of the waveforms as the circuitry of FIG. 1 operates.

A graphic illustration of how the circuitry of this invention functions to increase the amount of current, and hence power, being supplied to the solenoid 24 as the line voltage levels decrease can be found in the exaggerated waveforms illustrated in FIG. 3. In this Figure, the threshold level T5B starts at time zero at the level it would be corresponding to normal line voltage, and decreases rapidly. The waveform P4B is the ramp voltage input to the low side of comparator 14, and as this supply is regulated and independent of line voltage levels, it remains constant. However, as can be graphically seen with respect to waveform P6B, the threshold waveform P5B is exceeded by the ramp voltage levels P4B at earlier and earlier times in each succeeding cycle, with the result being that the duration of current flowing to the solenoid 24 keeps increasing as a proportion of each time cycle.

In addition to compensation for variations in voltage level, the circuitry of this invention also functions to provide an increased pull-in force, through increasing the current flow to the solenoid 24, whenever the system is initially powered on. This is accomplished predominantly through the use of the transistor T4 and the NOR gate 36. Whenever the system is initially turned on, such as by means of the switch 17, the switch 17 also turns on the momentary switch 19, which causes a signal to appear at the input of inverter 54. This signal is inverted by the inverter 54, and is transmitted via input 37 to the NOR gate 36. The output of the NOR gate 36, in turn, causes the gate of the field effect transistor T4 to be gated on, thus causing a current path to exist momentarily from the voltage tap 26 and bus B4 through transistor T4 to ground. By causing the voltage path to conduct to ground, the high side input to the comparator 14 is essentially zero, and hence the ramp voltage P4 exceeds the threshold level also continuously. Thus, at initial turn-on, the thyristor 20 is conducting almost continually, which causes a correspondingly large current-time flow to the solenoid 24. This threshold level at or near zero will occur until such time as the momentary switch signal 19 is removed, at some predetermined time after the initial start-up. This signal may preferably be provided by an optical switch (not shown) which senses the actual position of the solenoid 24.

Additionally, the circuitry of this invention can also function to increase current flow, and power, to hold the solenoid 24 in place upon the occurrence of shock or vibration which might otherwise cause the solenoid to unnecessarily trip out. This is accomplished by means of the shock switch 34. The shock switch 34 is normally open, and hence the voltage from the regulated 15 volt power supply 11 does not function to turn the transistor T3 on. However, upon the occurrence of a shock or vibration above a predetermined level, the shock switch 34 will close, causing the voltage from the supply 11 to impress a signal, through diode 32 and bus B5, onto the gate of transistor T3, causing the transistor T3 to conduct and create a path from Bus B4 to ground. This connection of bus B4 to ground causes the high input, or threshold level, to comparator 14 to be at or near zero, again causing the ramp voltage to equal or exceed the threshold level almost continuously, thereby resulting in an almost continuous flow of current to the solenoid 24. This current flow will continue until such time as the shock or vibration has ceased, resulting in the shock switch 34 reverting to its normally open position, which will remove the signal from the gate of transistor T3 and interrupt the current path to ground from bus B4. Diode 32, together with resistor R10 and capacitor C5, acts as a pulse stretching network to assure that the effect of even a momentary closure of the shock switch 34 is adequately registered.

Capacitor C6 and resistor R11 form, with comparator 38, a network to provide an emergency signal if the request for a boost is kept on for more than a time determined by the R11-C6 time constant.

Thus, it can be seen that this invention provides a simple means of varying the current and power levels to a solenoid depending upon the voltage levels of the lines in which the solenoid is connected, and which also provides for an increased pull-in force for the solenoid upon initialization of the system.

I claim as my invention:

1. Electrical apparatus comprising:

an electrically operated solenoid;

line voltage means at a line voltage level for supplying a source of current to said solenoid;

operable switch means interconnected between said line voltage means and said solenoid for regulating the flow of current from said line voltage means to said solenoid; and control circuit means coupled to said switch means for controlling the operation of said switch means, said control circuit means operating said switch means to increase the duration of current flow to said solenoid when said line voltage level decreases and comprising:

means for generating a reference voltage independent of said line voltage level;

means for generating a control voltage proportional to said line voltage level; and means for operating said switch means to permit current flow to said solenoid whenever said control voltage exceeds said reference voltage.

2. The apparatus according to claim 1 wherein said reference voltage generating means generates a ramp voltage, and said operating means comprises comparator means for comparing said control voltage to said ramp reference voltage.

3. The apparatus according to claim 2 wherein said control circuit means comprises vibration compensating means for operating said switch means to increase the duration of current flow to said solenoid upon the occurrence of vibration within said solenoid above a predetermined level.

4. The apparatus according to claim 3 wherein said vibration compensating means reduces the control voltage being supplied to said comparator means.

5. The apparatus according to claim 3 wherein said control circuit means comprises initialization means for operating said switch means to increase the duration of current flow to said solenoid upon initial energization of said solenoid.

6. The apparatus according to claim 5 wherein said initialization means reduces the control voltage being supplied to said comparator means.

7. Electrical apparatus comprising:

an electrically operated solenoid;

line voltage means at a line voltage level for supplying a source of current to said solenoid;

operable switch means interconnected between said line voltage means and said solenoid for regulating the flow of current from said line voltage means to said solenoid; and control circuit means coupled to said switch means for controlling the operation of said switch means, said control circuit means comprising shock compensating means for operating said switch means to increase the duration of current flow to said solenoid upon the occurrence of vibration within said solenoid above a predetermined level.

8. Electrical apparatus comprising:

an electrically operated solenoid;

line voltage means at a line voltage level for supplying a source of current to said solenoid;

operable switch means interconnected between said line voltage means and said solenoid for regulating the flow of current from said line voltage means to said solenoid;

control circuit means coupled to said switch means for controlling the operation of said switch means, said control circuit means comprising initialization means for operating said switch means to increase the duration of current flow to said solenoid upon initial energization of said solenoid; and means for monitoring said initialization means and providing an indication whenever said initialization means operates said switch means for a duration longer than a preset time.

* * * * *